United States Patent [19]

Reinehr et al.

[11] 4,180,617

[45] Dec. 25, 1979

[54] HYGROSCOPIC FIBERS AND FILAMENTS

[75] Inventors: Ulrich Reinehr, Dormagen; Hermann-Josef Jungverdorben, Grevenbroich; Toni Herbertz, Dormagen, all of Fed. Rep. of Germany

[73] Assignee: Bayer Aktiengesellschaft, Leverkusen, Fed. Rep. of Germany

[21] Appl. No.: 820,240

[22] Filed: Jul. 29, 1977

Related U.S. Application Data

[63] Continuation-in-part of Ser. No. 746,727, Dec. 2, 1976.

[30] Foreign Application Priority Data

Dec. 2, 1975 [DE] Fed. Rep. of Germany ..... 2554124
Apr. 28, 1977 [DE] Fed. Rep. of Germany ..... 2719019

[51] Int. Cl.[2] ..... D02G 3/00
[52] U.S. Cl. ..... 428/398; 428/373; 428/376; 428/397
[58] Field of Search ..... 428/398, 397, 376, 373, 428/374; 264/171

[56] References Cited

U.S. PATENT DOCUMENTS

| | | | |
|---|---|---|---|
| 2,045,370 | 6/1936 | Roberts et al. | 428/376 |
| 3,322,611 | 5/1967 | Stevenson | 428/398 |
| 3,695,992 | 10/1972 | Moulds | 428/398 |
| 3,957,936 | 5/1976 | Lauchenauer | 428/376 X |
| 3,984,515 | 10/1976 | Mommaerts | 428/398 X |
| 3,984,601 | 10/1976 | Blickenstaff | 428/376 X |

OTHER PUBLICATIONS

Fourne, *Synthetische Fasern,* 1964, pp. 234, 235, 246, 247, 258, 259, 270 and 271.

*Primary Examiner*—Lorraine T. Kendell
*Attorney, Agent, or Firm*—Sprung, Felfe, Horn, Lynch & Kramer

[57] ABSTRACT

The wearing comfort of textiles produced from synthetic fibers which are normally hydrophobic, e.g., polyacrylonitrile, is improved by modifications in the spinning process whereby hygroscopic fibers having a sheath/core structure and a microporous core are obtained, which fibers are capable of absorbing considerably more water than conventionally dry spun fibers of the same synthetic polymer not having a sheath/core structure. Several suitable dry spinning processes for producing the improved fibers are disclosed.

10 Claims, 4 Drawing Figures

HYGROSCOPIC FIBERS AND FILAMENTS

This application is a continuation-in-part of U.S. Ser. No. 746,727, filed Dec. 2, 1976.

Textile materials used for the production of clothing should provide good wearing comfort and must possess, as well, a number of other desirable properties. To achieve wearing comfort it is necessary that the human body be kept warm when inactive and when active that the heat and humidity generated, in gaseous and in liquid form, be permitted to escape from the body. It is specifically desirable to maintain a dry atmosphere near the body surface. Synthetic polymers provide many desirable textile properties but are generally deficient as to the comfort qualities required for clothing. It has now been found that outstanding wearing comfort can be achieved with a textile fiber prepared from a synthetic polymer by changing its physical properties during spinning to provide a fiber with a minimum water retention capacity and a minimum porosity, wherein the polymer from which the fiber is produced essentially does not swell when the fiber picks up water.

It has already been proposed in U.S. Patent Application Ser. No. 746,727 filed Dec. 2, 1976 to manufacture hygroscopic fibers and filaments of filament-forming synthetic polymers by adding to the spinning solvent 5 to 50%, based on the solvent and solid, of a substance which is readily miscible with the spinning solvent but which is essentially a non-solvent for the polymer and which has a higher boiling point than the spinning solvent; and then washing out this non-solvent from the fibers produced. The entire specification of U.S. Ser. No. 746,727 filed Dec. 2, 1976 is incorporated herein by reference.

The present invention therefore relates to fibers and filaments of filament-forming synthetic polymers, which have excellent hygroscopic properties and which give good wearing comfort when fashioned into articles of clothing. The hygroscopic properties and wearing comfort are primarily due to the physical makeup of the fibers which have a sheath/core structure, a porosity of at least 10%, a water retention capacity of at least 10%, and a fiber swelling which is lower than the water retention capacity.

The polymers used for the production of the filaments and fibers according to the invention are especially those which normally would be hydrophobic polymers, for example, polyamides, especially aromatic polyamides, polyesters, polyvinyl halides, but preferably acrylonitrile polymers which contain at least 40% by weight and more preferably at least 85% by weight of acrylonitrile units.

The term "sheath/core structure" as used herein is understood to refer to a structure which when observed in a stereo scan electron microscope, exhibits a distinct difference between the outer surface (sheath) and the inner portion of the cross-section (core) as compared to fiber samples prepared by conventional methods which are substantially uniform in cross-section. Specifically, the fibers of this invention contain voids and the voids observed in the core on the average are significantly larger than those in the sheath. Particularly, in one embodiment the sheath appears to be compact, which means it contains essentially no voids having a diameter larger than 300Å.

The thickness of the sheath is determined as the distance between the outer surface and that point where the said difference in structure is observed (when perpendicularly going from the outside to the middle of the fiber). The proportion of the sheath of the cross-section area of the fibers and filaments according to this invention amounts to 5–80% and preferably of from 10 to 50%.

The fibers and filaments of the invention exhibit an average void diameter of at most 10,000 Å, preferably at most 4,000 Å and most preferably of at most 2,000 Å. The voids in the core form a interconnected system (essentially no isolated voids) which is open to liquids, e.g., water, even through the sheath. Indeed, it is essential for the fibers and filaments according to this invention that the liquid pick-up not only occurs through the fiber ends but also through channels in the sheath.

The swellability of the fibers and filaments according to this invention preferably is significantly lower than the water retention capacity. The swellability, for example, should not exceed about 3% if the water retention capacity is about 10%. Even if the water retention capacity is higher, for example, 50–100%, the swellability should not exceed about 10%. An acrylonitrile copolymer consisting of 90% of acrylonitrile, 5.5% of methyl acrylate and 0.5% of sodium methallyl sulfonate shows a swellability Q of 2.5%. Of course, the swellability depends on the chemical composition of the polymers. According to this invention, only those polymers having a swellability of at most 10% are used.

The porosity of the fibers and filaments according to this invention is at least 10% and preferably at least 17%. The water retention capacity preferably is more than 20%.

The fibers and filaments according to this invention can be produced, as indicated above, by modifying a spinning process which is known per se, preferably by a dry-spinning process. In this process a solution is spun which contains in addition to the polymer and the spinning solvent as is conventional, from 5 to 50% by weight based on solvent and polymer solid of a substance which is essentially a non-solvent for the polymer and which is readily miscible with the solvent and with water or another liquid which is suitable as a washing liquid for the filaments. Care is taken that the non-solvent is not vaporized to any substantial extent during the spinning process. Thereafter, the non-solvent is washed out of the fibers.

If acrylonitrile polymers are used, the hydrophilicity even can be enhanced by using copolymers having hydrophilic groups. Suitable compounds are acrylic acid, methacrylic acid, methallyl sulfonic acid and its salts as well as acrylic acid amides.

As spinning solvent those are especially suitable, which are well-known in the dry-spinning technique such as dimethyl acetamide, dimethyl sulfoxide, N-methyl pyrolidone, and dimethyl formamide (DMF). Dimethyl formamide (DMF) is preferred.

The substance added to the spinning solution must be miscible with the solvent and with water or another liquid being suitable as a washing liquid for the filaments, preferably miscible at any ratio, and it must be a non-solvent for the polymer in a practical sense which means that the polymer is insoluble or is soluble in said substance at most in a minor amount.

Suitable substances are mono or polysubstituted alkyl ethers and esters and polyvalent alcohols, such as diethylene glycol mono- or dimethyl ether, or the appropriate ethyl or butyl ethers, diethylene glycol, triethylene glycol, tripropylene glycol, triethylene glycol diacetate, tetraethylene glycol, tetraethylene glycol methylether, glycol ether acetates, such as butyl glycol acetates. Also suitable, are high-boiling alcohols such as 2-ethyl cyclohexanol, esters, ketones and mixtures thereof. Preferably, glycerin and tetraethylene glycol are used. Solid substances such as sugars or solid polyvalent alcohols are suitable as well.

It is further advantageous to use substances that do not form azeotropic mixtures with the spinning solvent so that they can be regained to a large extent by fractional distillation as in the case of DMF/glycerin or DMF/diethylene glycol mixtures.

Those substances are added to the spinning solution in an amount of 5–50%, preferably 10–20% by weight, based on solvent and polymer solids. The upper limit thereby in practice is governed by the spinnability of the resulting solution. The higher the percentage-by-weight ratio of the added substance is the higher the porosity of the core in the fibers can be and accordingly the higher is the water retention capacity of fibers produced from such spinning solutions.

To obtain the fibers and filaments according to this invention having a favorably high porosity the spinning conditions are selected in such a way that as little as possible of the added substance is vaporized or carried out with the solvent in the spinning tube during the dry-spinning process. For this purpose it is desirable that the temperature of the spinning tube be as low as possible and only a little above the boiling point of the spinning solvent, and that short spinning tubes and high spinning speeds be used to ensure short residence times of the filaments in the spinning tube. For these reasons the temperature of the spinning tube should be at most 80% C. above, preferably from 5° to 30° C., above the boiling point of the spinning solvent used. Through these conditions the essential amount (normally about 90%) of said substance remains in the freshly spun filaments or the bundles of filaments, respectively. Then, later during the after-treatment of the filaments said substance is removed by washing it out and the filaments are made up in a conventional manner to yield filaments or fibers ready for use.

The wash-out step may be conducted at a temperature up to 100° C. The residence time of the filament in contact with the washing liquid should be at least 10 seconds to ensure a proper wash-out.

It has been found to be advantageous to keep the filaments only under low tension or to allow only a low shrinkage, respectively, during the washing step. This ensures an optimum wash-out.

The further after-treatment of the filaments or strands is conducted in a conventional manner such as treating it with an oil, crimping, drying and optionally cutting it.

The drying has a further influence on water take-up. Therefore, the drying conditions should be as mild as possible. A drying temperature of at most 160° C., preferably of from 110° to 140° C. and short residence times of the filaments in the dryer of as short as 2–3 minutes yield sheath/core fibers or filaments with high porosity and a high water retention capacity.

In a second process for preparing the fibers of this invention water is added to a conventional dry-spinning solution in an amount of from 2 to 25% by weight, based on the total mixture. In this case the mixture, before it is spun, is heated to at least a temperature at which where a clear solution results. The solution is then spun at a temperature which is above the gel point of said solution into a spinning tube. In this spinning process where the ratio of polymer:water is less than 4:1 the temperatures of the spinning tube and the air therein are preferably no higher than the temperature of the spinning solution. Where the ratio of polymer:water is 4:1 or more it is advantageous that the temperature of the spinning tube and the spinning air is above the temperature of the spinning solution.

In a third process for production of the fibers and filaments according to the invention, a conventional spinning solution is dry-spun and the filaments are contacted with steam or the vapor of another liquid capable of solidifying or coagulating the filaments immediately after the spinning solution has left the spinning orifice but before solidification or coagulation of the filaments is completed. The filaments are then washed with a liquid miscible with the spinning solvent, preferably water, to remove residual spinning solvent under conditions similar to those described in the first process.

This spinning process, in principle, is a conventional dry-spinning process, preferably from strongly polar organic solvents like DMF, dimethyl acetamide or dimethyl sulfoxide. However, it is also possible to spin a solution of polymer, solvent and non-solvent, as described above, according to this method.

Besides steam, vapors of liquids or substances which are non-solvents for the polymer used are suitable in the foregoing process. In the case of acrylonitrile these are, e.g., mono- or polysubstituted alkyl esters or ethers or polyvalent alcohols, such as diethylene glycol, triethylene glycol, tripropylene glycol, triethylene glycol diacetate, tetraethylene glycol and glycol ether acetates. Further suitable substances are alcohols like 2-ethyl cyclohexanol, glycerin, esters or ketones or mixtures thereof, for example, mixtures of ethylene glycol acetates. Besides water, those substances which are easily vaporized and which have a low flammability, such as methylene chloride or carbon tetrachloride, are preferred.

Depending on the point at which steam or other suitable vapor is blown into the spinning tube and on the intensity and depending on the thermic conditions in the spinning tube it is possible to influence the cross-section, the width of the sheath and the hydrophilicity of the fibers. A circular cross-section and a thin sheath of at most 25% of the whole cross-sectional surface area and an extremely high water-retention capacity of about 60% and more is obtained if the spinning is conducted with low temperatures of the spinning tube of at most 140° C., preferably of from 20° to 120° C.

If the spinning tube temperatures are higher, preferably above 160° C., sheath/core structured fibers are obtained having an oval to trilobal shaped cross-section and having water retention capacities of from 20 to 60% and the sheath comprises up to about 60% of the total cross-sectional surface area.

The width of the sheath can also be governed by the selection of the ratios of air to steam. With high amounts of steam and relatively low amounts of air, fibers with a large sheath width can be obtained, having, for example, a sheath of up to 80% of the total cross-sectional surface area. Conversely, if only little steam relative to air is used, sheath/core fibers are obtained having only a small sheath and a low water retention capacity.

To avoid a too high condensation of water and solvent within the spinning tube it has been found that the optimum temperature in the spinning tube should be more than 100° C., preferably of 105° to 140° C., and that the length of the spinning tube be as short as possible, for example, about 1 meter.

In order to obtain the minimum porosity of at least 10%, the non-solvent (in the process described first) is added to the spinning solution in an amount of at least 10% based on the polymer solids, care is taken of the non-solvent not being essentially evaporated in the spinning tube and treating the filaments under mild thermic conditions so that the voids will not collapse when producing the fibers. The water retention capacity is at least 10% if the porosity is at least 10%.

The selection of the polymers is such that the swellability does not exceed 10%. This ensures that the water retention capacity is not primarily due to the chemical constitution of the polymer but to the porous structure of the fiber prepared from the polymer.

As previously indicated, fibers and filaments according to the present invention have an average void diameter of at most 10,000 Å. The size of the pores can be influenced by the spinning and after-treatment conditions. In the first described process involving the addition of a non-solvent an average void size of about 4,000 Å is obtained when high-boiling non-solvents like glycerin or tetraethylene glycol are added and the temperature of the spinning tube is about 180° C. and the spinning air has a temperature of about 350° C.

Smaller pores can be obtained when both temperatures are decreased. Hence, an average pore-diameter of about 2,000 Å can be achieved if the said temperatures are below the boiling point of the spinning solvent used.

By the processes described above fibers are produced having pores in the core which are connected to each other like a canal system. At the same time a sheath structure is produced which is capable of penetration by water which is then picked up by the core.

Besides the methods described above the width of the sheath can be influenced by the ratio of polymer solids to amount of non-solvent. The higher the ratio of polymer solids to non-solvent the larger the width of the sheath will be. Thus, a desired width of the sheath can easily be achieved by simple tests.

As it is well-known, synthetic fibers or yarns or textile articles thereof have a wet feeling after being contacted or contaminated with a low amount of water. For example, a commercial acrylonitrile fiber feels wet after moistening with 5% or more water. On the other hand, the fibers and filaments according to the present invention exhibit a higher wet-feel limit of at least 6%. It is obvious that his minimum value depends on the chemical composition of the spun polymer. When an acrylonitrile polymer has been spun according to this invention the wet-feel limit is found to be about 10% or more.

The wet-feel limit can be influenced by the porosity which itself is governed as described above. If, for example, the water retention capacity is more than 12% then the wet-feel limit is increased to more than 10%. If the water retention capacity is increased to more than 20%, then the wet-feel limit increases to more than 15%. These figures are particularly related to fibers of acrylonitrile polymers.

It is important to comfort that the perspiration caused by sudden activity of the wearer be rapidly picked up by the pores of the fibers of the textile. A sufficient pick-up is achieved if the pore-volume of the fibers fills within 5 minutes to at least 20%, preferably to at least 30%. The fibers and filaments according to the present invention fulfil these requirements. Accordingly, they are very suitable for the production of clothes giving an outstanding wearing comfort to the wearer.

With respect to the wearing comfort it is of further importance that the fibers in a yarn can rapidly carry away the humidity. For this purpose textiles prepared from fibers of circular cross-sections are especially suitable. Round cross-sections can be produced as already described above.

If the activity of the human body is low, such as in the case of light work, only little humidity in liquid form results. In those cases it is advantageous if the textile also absorbs water vapor and thereby causes a dry atmosphere near the skin of the wearer.

It has been found in wear tests and ergometer tests that the degree of humidity absorption in one definite point of the sorption-isothermal line is not as important as the differences of the water absorption capacity at different relative humidities. For example, the water absorption capacity at say 65% r.h. is not as significant as the comparison of water absorption capacity at 65% and 95% relative humidity, respectively. Preferably, this difference should be more than 2% to result in wearing comfort. More preferably, the difference should be at least 5%.

The fibers and filaments according to the invention exhibit outstanding behaviour under the criteria described above because they have a water absorption and desorption capacity of more than 1%, if they are intermittently exposed to 65% r.h. and 95% r.h., respectively, at 20° C., the humidity being changed every 20 minutes. Such a rapid pick-up of humidity is especially useful when the activity of the human body rapidly changes.

The degree of the water absorption is particularly influenced by the size of the pores and/or by additives to the fibers. This water absorption capacity can be increased by the generation of small and medium voids having an average diameter of at most 1,000 Å and can also be increased by the copolymerization of hydrophilic comonomers or addition of hydrophilic additives. Such additives can be incorporated during the manufacture of the fibers or during an after-treatment step.

A difference in the water absorption capacity (ΔFA value) of more than 3% is obtained if the portion of the pore-volume of the pores having a pore-diameter of less than 500 Å is at least 30 $mm^3/g$ of the fibers.

The void structure of the fibers and filaments according to this invention is also advantageous for the drying of the fibers because this structure promotes a rapid vaporization of the humidity as well. Thus, a heat-trap is prevented if the activity of the body is high.

The fibers and filaments according to this invention possess, by virtue of their porous sheath/core structure, a high capacity to imbibe water, without essential swelling, high humidity transport velocity, a high wet-feel limit and a high water absorption capacity. Furthermore, they have a low density which results from porous structure.

Through the cumulation of these advantageous and desirable properties in a single fiber, the fiber is highly suitable for conversion to textile articles, particularly clothes, which give a very good wearing-comfort.

The physical parameters mentioned in the above description have been determined as follows. These methods relate to dyed or blind-dyed fibers, respectively, which have been deliberated from preparation and to yarns or textile articles made thereof.

MEASUREMENTS (methods)

Mercury density ($\rho$Hg)

Figure 1:
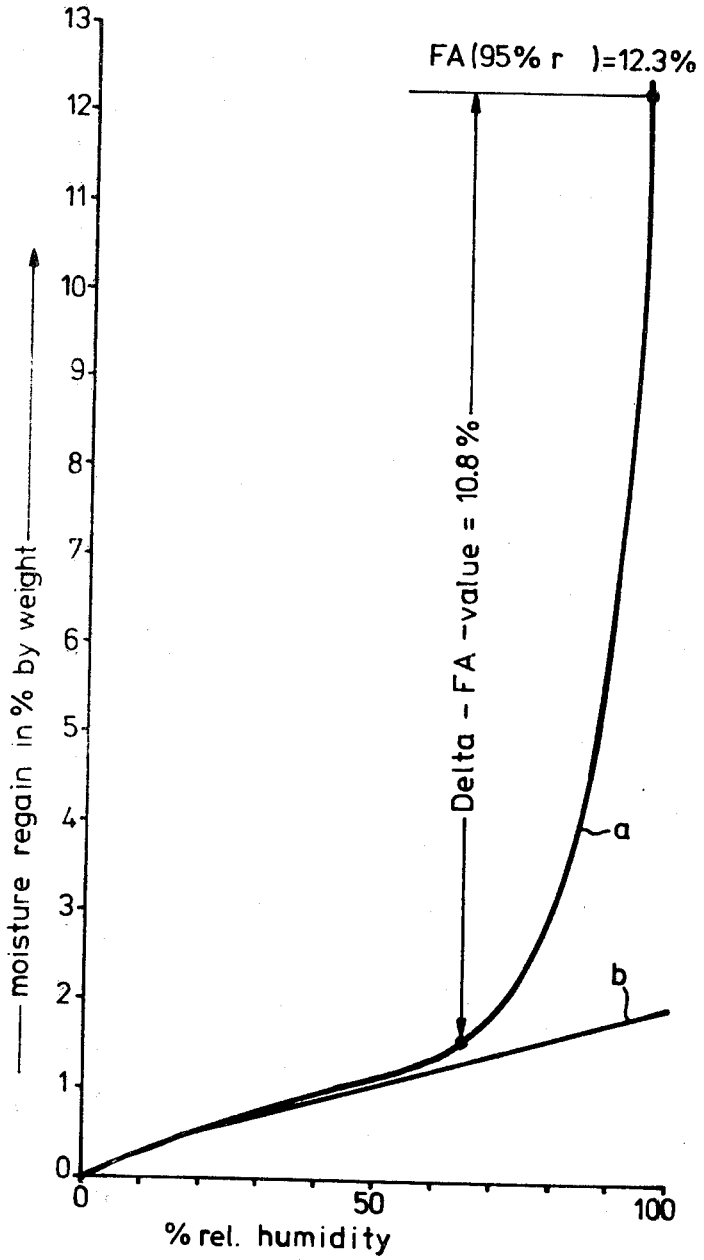
FIG. 1 is a graph relating moisture absorption to relative humidity for a fiber according to this invention and for a commercially available fiber.

After a sample has been heated at 50° C. under vacuum ($10^{-2}$ mbar) the mercury density (average apparent density) is determined by volume measurements in mercury at a super atmospheric pressure of 10 bar.

Helium density ($\rho$He)

After heating the sample at 50° C. under vacuum ($10^{-2}$ mbar) the helium density ("true density") is determined by volume measurement in a helium atmosphere in a gas comparison pyknometer.

Definition of the porosity (P)

$$P=[1-(\rho Hg/\rho He)].100\%$$

Flotation density ($\rho$F)

Several dry skeins of fibers were weighted exactly (with an exactness of 0.1 mg) ($m_1$) and submerged in water (density $\rho$ $H_20$). After 5 minutes the weight of the skeins in water of 20° C. is determined ($m_2$); the flotation density (after 5 minutes) yield to $$\rho F = \frac{m_1}{m_1 - m_2} \cdot \rho H_2O$$

Definition of the sheath/core structure

Samples which have been prepared by usual techniques (freeze-break, ion-etching and gold vapor deposition) exhibit a sheath/core structure in a stereo scan electron microscope which is characterized in that the voids recognizable in the core on the average are evidently larger than the voids in the sheath. Particularly the sheath can appear compact, i.e., has essentially no voids with a diameter of more than 300 Å. The thickness or width of the sheath is determined as the distance between the outer surface and that point where the just described difference in structure is observed (when perpendicularly going from the outside to the middle of the fiber).

Water retention capacity (WR)

The water retention capacity is determined in analogy to DIN 53814 (as described in Melliand Textilberichte 4, 1973, page 350). The fiber samples are submerged in water for 2 hours. The water contains 0.1% wetting agent. Thereafter the fibers are centrifuged with an acceleration of 10,000 m/sec$^2$ for 10 minutes and the amount of water retained in the fibers is gravimetrically determined. To determine the dry weight of the fibers they are dried at 105° C. until the humidity is constant. The water retention capacity in percent by weight is $$WR = \frac{m_f - m_{tr}}{m_{tr}} \cdot 100$$

$m_f$ = weight of the wet fibers
$m_{tr}$ = weight of the dry fibers.

Average pore diameter (d)

The average pore diameter d is determined from the porosity P and the inner surface O according to the 1-point-BET-method with nitrogen (starting pressure: 1 atu gauge; sorption temperature: liquid nitrogen boiling point)

$$\frac{d}{nm} = 4 \cdot 10^3 \cdot \frac{P}{100\% - P} \cdot \frac{m^2/g}{O} \cdot \frac{1\ g/cm^3}{(\rho He/g/cm^3)^2}$$

Further electron-microscopic pictures of contrasting thin-cuts and stereo-scan electronic microscope pictures of break-surfaces have been evaluated for the determination of the pore structure. The values determined optically normally are greater than the value d.

Wet-feel limit (FFG)

A series of samples of the same kind were moistened evenly with water and then differently hurled off and weighed. At least 5 test persons had then to determine which fibers already felt wet. If the majority of the test people testified so, the wet-feel limit was passed over. As a control, the fibers were again weighed and the water content was determined by drying. The wet-feel limit is the minimum water content which just induces a wet feel.

Moisture absorption capacity (FA)

After drying at 50° C./0.1 Torr under nitrogen up to weight constancy the dry weight of a sample is determined on a vacuum balance (exactness 0.2 mg). While intermittently blowing in and sucking off water vapor (20° C.) a water vapor pressure is adjusted which corresponds to 65% relative humidity. When the samples had a constant weight the weight again has been determined:

$$FA = \frac{m_f - m_{tr}}{m_{tr}} \cdot 100\%$$

$m_f$ = weight of the wet fiber
$m_{tr}$ = weight of the dry fiber

Thereafter analogous measurements have been made at higher relative humidities.

Degree of pore-fill with water (F)

The pore-fill is determined by comparison of the mercury density $\rho_{Hg}$ with the flotation density $\rho_F$ in water after 5 minutes submerging wherein the flotation density is determined gravi-mechanically.

$$F = \left(1 - \frac{(\rho_{He}/\rho_F) - 1}{(\rho_{He}/\rho_{Hg}) - 1}\right) \cdot 100\%$$

ΔFA value

The ΔFA-value is calculated as the difference between moisture absorption at 95% r.h. and 65% r.h. each measured in the equilibrium state as described above.

Kinetic ΔFA-value

The kinetic ΔFA-value is determined by measuring the moisture absorption and desorption at 20° C., periodically changing the relative humidity to 65% and 95% every 20 minutes.

Polymer swelling (Q)

The moisture absorption of non-porous polymer (fibers) is determined from 0 up to 95% r.h. and is extrapolated to 100% (FA 100). The increase in weight corresponds to the polymer swelling $$Q(\%)=FA_{100}\cdot\rho He1\ g/cm^3$$

Q of copolymers with hydrophilic comonomers can be different from the true swelling. Nevertheless Q is used for characterizing the swellability.

Permeability of the sheath for water

The water retention capacity is determined with the following modifications: the dry filaments were submerged in water in the form of a U without the ends being in the water. In this way the water pick-up occurs only through the sheath. Thereafter it proceeded as described under"water retention capacity". The sheath is permeable or penetratable if after a moistening in 5 minutes the water retention capacity is at least 20% of the original water retention capacity WR.

Determination of the continuous character of the canal pore system

For this purpose the porous sheath/core fibers are prepared as follows: in several baths the water within the pores of the fibers is exchanged against an intermedium and this intermedium is substituted in a following concentration series by the real compound to be embedded, an epoxy resin. The water pick-up, the dehydrogenation and embedding of the resin is conducted under vacuum to avoid occlusion of gas and to so achieve an optimized fill of the voids. The fibers containing the resin are then cut in cryomicrotom at a temperature of −100° C. and the thin-cuts are contrasted.

Figure 3:
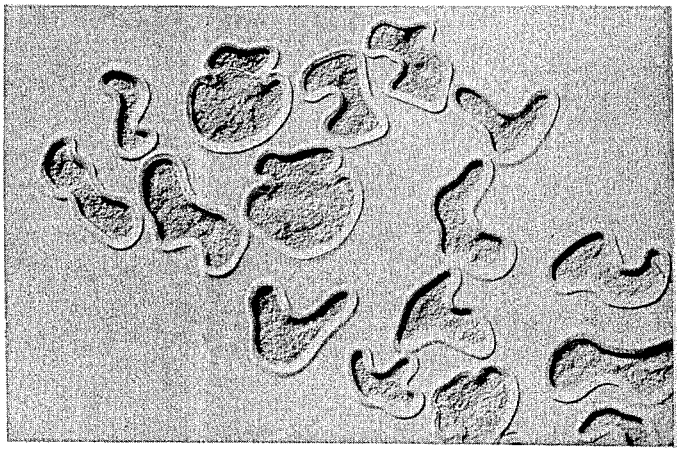
FIG. 3 is a transmission-electron microscope picture of a cross-section, taken perpendicular to the axis, of the fibers of this invention.
Figure 4:
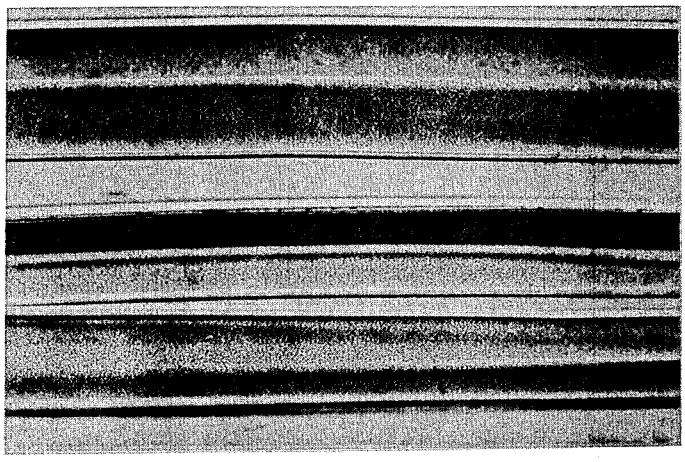
FIG. 4 is a transmission-electron microscope picture of a cross-section, taken parallel to the axis, of the fibers of this invention.

In the transmission-electron microscope pictures (FIGS. 3 and 4) the resin in the pores and surrounding the fibers appears darker than the fiber matrix and characterizes the permeability of the porous system for liquids of the core and the sheath as well.

FIG. 1 shows the dependency of the moisture absorption in percent by weight of a fiber according to the invention (prepared according to Example 4, curve a) on the relative humidity in percent compared with a commercially available acrylic fiber (curve b).

Figure 2:
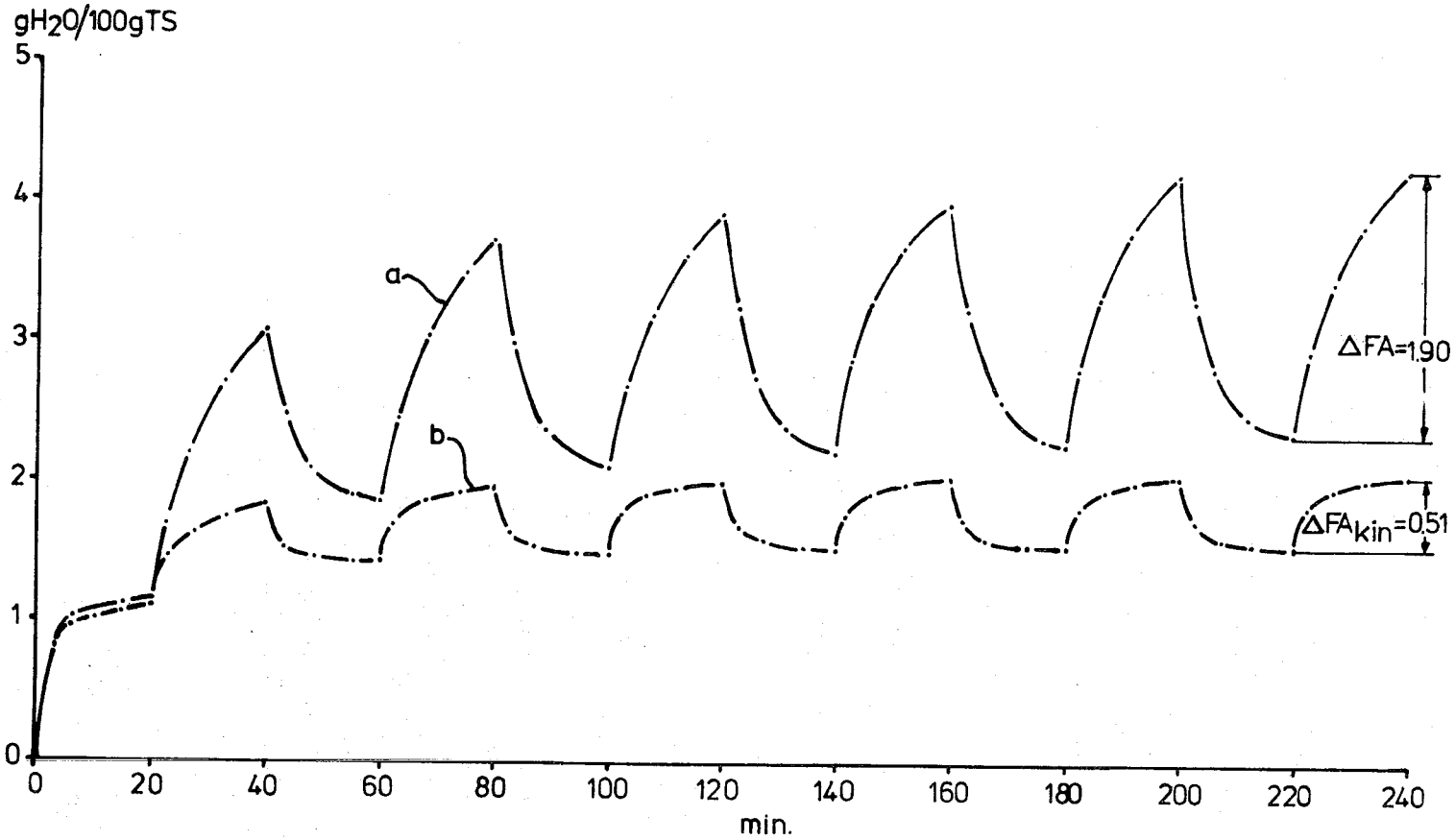
FIG. 2 is a graph showing kinetic sorption of water relative to periodically changing humidity for the same fibers in FIG. 1.

FIG. 2 shows the same fibers as in FIG. 1 with respect to their kinetic sorption of water vapor when periodically changing the relative humidity (65% and 95% r.h.) at 20° C. (kinetic ΔFA value).

EXAMPLES

EXAMPLE 1

19.9 kg of DMF were mixed while stirring with 4.8 kg of glycerol in a vessel. Thereafter 5.1 kg of an acrylonitrile copolymer of 93.6% of acrylonitrile, 5.7% of methyl acrylate and 0.7% of sodium methallyl sulphonate were added while stirring. The resulting mixture was stirred for 1 hour at 80° C., filtered and the completed spinning solution dry spun from a 180 bore spinneret in a spinning duct by methods known in the art.

The duct temperature was 160° C. The viscosity of the spinning solution, which had a solids concentration of 17% and a glycerol content of 15.7% by weight, based on DMF+polymer powder, amounted to 85 ball drop seconds. For determining viscosity by the ball drop method, see K. Jost, Rheologica Acta, Vol. 1, No. 2–3 (1958), page 303. The spun material with a denier of 1700 dtex was collected on bobbins and then doubled into a sliver with an overall denier of 102,000 dtex. After leaving the spinning duct, the sliver still contained 14.1% by weight of glycerol.

The glycerol content of the sliver was determined by gas chromatographic analysis. The tow was then drawn in a ratio of 1:3.6 in boiling water, washed for 3 minutes under slight tension in boiling water and provided with antistatic preparation. This was followed by drying in a screen drum dryer at a maximum temperature of 130° C. with a permitted shrinkage of 20% after which the tow was cut into fibers with a staple length of 60 mm.

After leaving the duct the fibers showed an expressive sheath/core structure in a stress-scan electron microscope (magnification 780–3800) and irregular, mostly trilobal cross-sections.

The individual fibers with a final denier of 3.3 dtex had a helium density of 1.17 g/cm$^3$, a mercury density of 0.862 g/cm$^3$. amd a water retention capacity of 32.8%. The porosity was 26.4%, the inner surface was 9.7 m$^2$/g and the average pore diameter was 106 nm.

The jacket surface had a width of approximately 4 μm. In order to determine the core and jacket area of the fibers, more than 100 fibers cross-sections were evaluated by quantitative analysis with a Leitz "Classimat" image analyzer. On average 32% of the cross-sectional area was occupied by the width of the jacket. The wet-feel limit was about 24%, and the pore-fill in water after 5 minutes was 71%. The moisture absorption at 95% r.h. and 20° C. was 12%, the ΔFA value was 6.8% and the kinetic ΔFA value was 2.0%. The fibers can be dyed deeply throughout with a blue dye corresponding to the formula

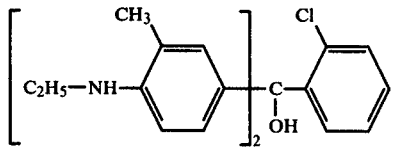

The extinction value amounted to 1.39 for 100 mg of fiber per 100 ml of DMF (570 mμ, 1 cm cuvette).

Yarns with a count of 36/1 were spun from the fibers with a final denier of 3.3 dtex, and made up into pieces of knitting. The pieces, some of which were left white and others dyed blue, were found to have a water retention capacity of 34.3%.

EXAMPLE 2

10.4 kg of DMF were mixed while stirring with 2.15 kg glycerol in a vessel. Thereafter 2.85 kg of an acrylonitrile copolymer of 90% acrylonitrile, 5% of acrylamide and 5% of N-methoxymethylacrylamide were added while stirring. The resulting mixture was stirred for one hour, filtered, and the completed spinning solution spun as described in Example 1.

The viscosity of the spinning solution which had a solids content of 15% by weight and a glycerol content of 14.5% based on DMF and polymer solids was 69 ball drop seconds. The spun material of a denier of 1700 dtex was again doubled into a sliver and then treated as described in Example 1.

The fibers again had an irregular cross-section generally trilobal shaped and a marked sheath/core structure.

The individual fibers with a final denier of 3.2 dtex were determined to have the following physical properties:

| | |
|---|---|
| helium density | 1.19 g/cm$^3$ |
| mercury density | 0.857 g/cm$^3$ |
| porosity | 28.0% |
| water retention capacity | 34.9% |
| inner surface | 7.6 m$^2$/g |
| average pore diameter | 145 nm |
| sheath surface | 35% |
| wet feel limit | 25% |
| pore-fill (after 5 min.) | 64% |
| moisture absorption (95% r.h.) | 11% |
| ΔFA value | 5.7% |
| kinetic Δ FA value | 1.5% |

EXAMPLE 3

60 kg DMF were mixed with 17.5 kg of glycerol in a vessel while stirring. Thereafter 22.5 kg of the copolymer of Example 1 were added while stirring and stirring was continued for one hour at 80° C. Then, after filtering the solution was conventionally dry spun through a 496-bore spinneret.

The temperature of the spinning duct was 180° C., the viscosity of the solution having a solids content of 22.5% and a glycerol content of 17.5% was 85 ball drop seconds.

The spun material with a denier of 6850 dtex was collected and doubled into a tow. The tow was then stretched in a ratio of 1:3.6 in boiling water, then washed in boiling water for 3 minutes under slight tension and finished with an antistatic preparation. This was followed by drying in a screen drum dryer at a temperature of 100° C. with a permitted shrinkage of 10% after which the tow was cut into fibers with a staple length of 60 mm.

The individual fibers with a final denier of 1.9 dtex were determined to have the following properties:

| | |
|---|---|
| helium density | 1.18 g/cm$^3$ |
| mercury density | 0.918 g/cm$^3$ |
| porosity | 18.8% |
| water retention capacity | 25% |
| inner surface | 3.9 m$^2$/g |
| average diameter | 170 nm |
| sheath surface | 21% |
| wet-feel limit | 19% |
| pore-fill (20 minutes) | 78% |
| moisture absorption (95% r.h.) | 4.9% |
| Δ FA value | 3.1% |
| kinetic Δ FA value | 1.2% |

The fibers had a tensile strength of 2.3 p/dtex and an elongation at break of 46%. The relative loop tensile strength was 61% and the relative loop elongation at break 30%. The fibers were then made up to yarns of Nm 36/1 from which textile articles like T-shirts and socks were manufactured. These articles had excellent wearing comfort properties. The above values of the physical properties were reproduced when measuring the textile articles.

Knitting fabrics of the same construction were made from (1) wool, (2) cotton, (3) commercially available acrylic fibers, and (4) fibers according to this Example and the climb-up speed was measured according to DIN 53924. After 5 minutes the values were determined as follows:

(1) 0 cm
(2) 11 cm
(3) 3.5 cm
(4) 9 cm

The same fabrics then were subjected to drying tests. All having the same starting moisture of 150 g water/m$^2$ the following drying times were found:

(1) and (2) more than 120 minutes
(3) 60 minutes
(4) 65 minutes

The residual moisture was 5% in each case.

EXAMPLE 4

52 kg of DMF were mixed with 12 kg of tetraethylene glycol in a vessel while stirring. Then 36 kg of the copolymer of Example 1 were added while stirring at room temperature. Thereafter the suspension was heated to 135° C., filtered and spun. The period from heating to spinning was 5 minutes.

The spinning solution was spun through a 72 bore spinneret in a spinning duct of 30° C., the spinning air temperature was 40° C. The amount of spinning air was 40 m$^3$ per hour. The spun material was collected on bobbins and then doubled into a tow of a total denier of 1,708,000 dtex. This tow was then stretched in boiling water in a ratio of 1:4.0, washed, provided with antistatic preparation and dryed permitting a shrinkage of 20%. The tow was crimped and cut to fibers of 100 mm length. The individual fibers had a final denier of 11 dtex and had a marked sheath/core structure.

The following physical properties were found:

| | |
|---|---|
| helium density | 1.9 g/cm$^3$ |
| mercury density | 0.834 g/cm$^3$ |
| porosity | 30.8% |
| water retention capacity | 38% |
| inner surface | 56.2 m$^2$/g |
| average pore-diameter | 25 nm |
| sheath surface | 5% |
| pore-fill (after 5 minutes) | 40% |
| moisture absorption (95% r.h.) | 12.3% (see FIG. 1) |
| Δ FA value | 10.8% (see FIG. 1) |
| kinetic Δ FA value | 1.9% (see FIG. 2) |
| permeability of sheath = WR after 5 minutes | 15% |

EXAMPLE 5

The polymer of Example 1 having a K-value of 81 was dissolved in DMF at 80° C. The filtered spinning solution which had a final concentration of about 30% by weight of polymer was dry-spun through a 180 bore spinneret. From above the spinneret 25 kg of saturated steam per hour and 10 m$^3$ air of 150° C. per hour were blown into the spinning duct which had a length of 600 cm and an internal diameter of 30 cm. The temperature of the duct was 140° C. 5.8 kg of steam were used per kg of spun material. The DMF content of the as-spun filaments was about 59%. The filaments of a total denier of 2400 dtex were collected on bobbins and then doubled into a tow of a denier of 684,000. This tow was stretched in boiling water at a ratio of 1:4.0, washed, provided with antistatic preparation, dryed at 120° C. while permitting a 20% shrinkage, crimped and cut into fibers of a staple length of 60 mm.

The individual fibers of a final denier of 3.3 dtex showed the following physical properties:

| | |
|---|---|
| helium density | 1.19 g/cm$^3$ |
| mercury density | 0.615 g/cm$^3$ |
| porosity | 48.3% |
| water retention capacity | 63% |
| inner surface | 19.2 m$^2$/g |
| average pore diameter | 46 nm |
| sheath area | 45% |
| wet feel limit | 38% |
| pore-fill (5 minutes) | 33% |
| moisture absorption (95% r.h.) | 8.3% |
| Δ FA value | 6.9% |
| kinetic Δ FA value | 1.7% |
| permeability of sheath = WR after 5 minutes | 26% |

EXAMPLE 6

The polymer of Example 5 was dissolved as described in Example 5 and spun. The amount of steam was 2.8 kg per kg of spun material, the air was 10 m$^3$/hour at a temperature of 150° C. The duct temperature was 160° C.

The filaments were further treated as in Example 5. The final denier was 3.3 dtex and the cross-section was dumbbell shaped.

Physical properties:

| | |
|---|---|
| sheath area | 70% |
| water retention | 12% |
| fiber density | 1.05 g/cm$^3$ |
| porosity | 11.8% |
| inner surface | 1.9 m$^2$/g |
| average pore diameter | 199 nm |

-continued

| | |
|---|---|
| wet feel limit | 7% |

We claim:

1. A hydroscopic filament or fiber of a fiber-forming synthetic polymer having a water permeable sheath and a microporous core in which both the sheath and the core contain voids, the voids in the core forming an interconnected system open to liquids through voids in the sheath, and in which the average size of the voids in the core is at most 10,000 Å and is significantly larger than the size of the voids in the sheath; a water retention capacity of at least 10%; a porosity of at least 10%; and a fiber swellability of at most 10% which is lower than the water retention capacity.

2. The filament or fiber of claim 1 which is dryspun.

3. The filament or fiber of claim 1 wherein the proportion of the sheath of the cross-section area is from 5 to 80%.

4. The filament or fiber of claim 1 having a wet-feel limit of at least 6%.

5. The filament or fiber of claim 1 having an equilibrium moisture pick-up of more than 5% at 95% r.h. and 20° C.

6. The filament or fiber of claim 1 having a difference in the moisture pick-up between 65% and 95% r.h. and 20° C. is at least 2%.

7. The filament or fiber of claim 1 having a moisture absorption or desorption, respectively, of at least 1% if the relative humidity at 20° C. is changed from 65% r.h. to 95% r.h. every 20 minutes and vice versa.

8. The filament or fiber of claim 1 comprising an acrylonitrile polymer of at least 40% of acrylonitrile units having a porosity of at least 17%, a water retention capacity of at least 20%, a mercury density of at most 1.0 g/cm$^3$ and a wet-feel limit of at least 10%.

9. The filament or fiber of claim 1 having an average diameter of the voids in the core of at most 4,000 Å.

10. The filament or fiber of claim 1 having a mercury density of 0.615 g/cm$^3$ or more.

* * * * *